US008939699B2

(12) United States Patent
Tsukane

(10) Patent No.: US 8,939,699 B2
(45) Date of Patent: Jan. 27, 2015

(54) CONSTRUCTION MACHINE WITH HYDRAULIC PIPES

(75) Inventor: Koichiro Tsukane, Kanagawa (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 267 days.

(21) Appl. No.: 13/641,730

(22) PCT Filed: Apr. 19, 2011

(86) PCT No.: PCT/JP2011/059623

§ 371 (c)(1), (2), (4) Date: Oct. 17, 2012

(87) PCT Pub. No.: WO2011/132673

PCT Pub. Date: Oct. 27, 2011

(65) Prior Publication Data

US 2013/0034419 A1 Feb. 7, 2013

(30) Foreign Application Priority Data

Apr. 20, 2010 (JP) ..... 2010-097216

(51) Int. Cl.

| | |
|---|---|
| ***E02F 3/00*** | (2006.01) |
| ***E02F 9/22*** | (2006.01) |
| ***E02F 3/42*** | (2006.01) |

(52) U.S. Cl.

CPC ..... *E02F 9/2217* (2013.01); *E02F 3/425* (2013.01)

USPC ..... 414/699; 414/697; 414/708; 298/11; 298/22 R; 298/22 C

(58) Field of Classification Search

CPC ..... E02F 9/2217; E02F 9/2239; E02F 9/2225; E02F 3/425

USPC ..... 414/697, 699, 708, 722; 298/11, 22 R, 298/22 C

See application file for complete search history.

(56) References Cited

U.S. PATENT DOCUMENTS

| | | | | | |
|---|---|---|---|---|---|
| 2,890,805 | A | * | 6/1959 | Pilch | 414/699 |
| 3,094,229 | A | * | 6/1963 | Johnson et al. | 414/694 |
| 3,927,781 | A | * | 12/1975 | Okabe | 414/708 |

FOREIGN PATENT DOCUMENTS

| | | | | |
|---|---|---|---|---|
| JP | 60-250128 | | 12/1985 | |
| JP | 60250128 | A * | 12/1985 | E02F 3/43 |
| JP | 61-009454 | | 1/1986 | |
| JP | 01-199002 | | 8/1989 | |

(Continued)

OTHER PUBLICATIONS

International Search Report mailed on Jul. 26, 2011.

*Primary Examiner* — Gerald McClain
(74) *Attorney, Agent, or Firm* — IPUSA, PLLC

(57) ABSTRACT

In a construction machine, a boom assist cylinder (7A) assists an operation of a boom (4) by a hydraulic pressure, and an arm assist cylinder (8A) assists an operation of an arm (5) by a hydraulic pressure. An accumulator (16) accumulates operation oil to be supplied to the boom assist cylinder and the arm assist cylinder in a pressurized state. A first hydraulic pipe (14) connects between the boom assist cylinder and the arm assist cylinder. A second hydraulic pipe (12) connects between the arm assist cylinder and the accumulator. The second hydraulic pipe is connected to a hydraulic connection port of the arm assist cylinder so that the operation oil is supplied in a direction of closing the arm from the accumulator to the arm assist cylinder.

4 Claims, 10 Drawing Sheets

(56) References Cited

FOREIGN PATENT DOCUMENTS

| | | | | | | |
|---|---|---|---|---|---|---|
| JP | 05-064253 | U | | 8/1993 | | |
| JP | 2582310 | | | 2/1997 | | |
| JP | 09-242127 | | | 9/1997 | | |
| JP | 09242127 | A | * | 9/1997 | ..... | E02F 9/22 |
| JP | 2004-011524 | | | 1/2004 | | |

* cited by examiner

CONSTRUCTION MACHINE WITH HYDRAULIC PIPES

TECHNICAL FIELD

The present invention relates to a construction machine that performs a work by driving a moving element such as a boom, an arm, etc.

BACKGROUND ART

There is a hydraulic shovel as an example of a typical construction machine. Generally, a hydraulic shovel has a boom, an arm attached at an extreme end of the boom, and a bucket attached at an extreme end of the arm. The boom, the arm and the bucket are driven by hydraulic cylinders. The boom is driven by a boom cylinder provided to the boom, the arm is driven by an arm cylinder provided to the arm, and the bucket is driven by a bucket cylinder provided to the bucket.

During a work by the hydraulic shovel, a hydraulic pressure is supplied to these hydraulic cylinders and the bucket is lifted by the boom and the arm. The bucket, the arm and the boom are heavy loads, and when these are raised, a considerable potential energy is generated. Accordingly, if this potential energy is recoverable, the energy efficiency of a work by the hydraulic shovel can be improved.

Thus, there is suggested a method of recovering potential energy of an attachment by providing an assist cylinder to a boom and connecting the assist cylinder to an accumulator (for example, refer to Patent Document 1).

Moreover, there is suggested a method of recovering potential energy of an attachment by providing assist cylinders to a boom and an arm and connecting the assist cylinders to an accumulator (for example, refer to Patent Document 2).

PRIOR ART DOCUMENT

Patent Document

PATENT DOCUMENT 1: Japanese Laid-Open Patent Application No. 2004-11524

PATENT DOCUMENT 2: Japanese Laid-Open Patent Application No. 9-242127

SUMMARY OF THE INVENTION

Problems to be Solved by the Invention

According to the energy recovering method by the assist cylinder and the accumulator disclosed in the above-mentioned Patent Document 1, an appropriate boom assist force cannot be obtained in response to an arm angle, so that energy cannot be recovered sufficiently.

According to the energy recovering method by the assist cylinders and the accumulator disclosed in the above-mentioned Patent Document 2, the arm is assisted by the assist cylinder not in an excavating direction (closing direction) but in a raising direction (opening direction). In this structure, the assist cylinder of the arm is an obstacle when acquiring an appropriate boom assist force in response to an arm angle, and energy cannot be sufficiently recovered. Moreover, when performing excavation, the assist cylinder of the arm serves as a load, which invites an increase in a hydraulic pressure peak output in its entirety so that an engine to drive such a hydraulic pump must be large.

Means to Solve the Problem

It is a general object of the present invention to provide a novel and useful construction machine in which the above-mentioned problems are eliminated.

A more specific object of the present invention is to provide a construction machine which is capable of efficiently recovering potential energy of a bucket, a boom and an arm.

In order to achieve the above-mentioned object, there is provided according to an aspect of the present invention a construction machine that drives a work attachment by a boom and an arm, including: a boom assist cylinder that assists an operation of the boom by a hydraulic pressure; an arm assist cylinder that assists an operation of the arm by a hydraulic pressure; an accumulator that accumulates operation oil to be supplied to the boom assist cylinder and the arm assist cylinder in a pressurized state; a first hydraulic pipe connecting between the boom assist cylinder and the arm assist cylinder; and a second hydraulic pipe connecting between the arm assist cylinder and the accumulator, wherein the second hydraulic pipe is connected to a hydraulic connection port of the arm assist cylinder so that the operation oil is supplied in a direction of closing the arm from the accumulator to the arm assist cylinder.

In the above-mentioned construction machine, the first hydraulic pipe is preferably connected to a hydraulic connection port of the boom assist cylinder so that the operation oil is supplied in a direction of raising the boom from the accumulator to the boom assist cylinder. Additionally, accumulation of hydraulic pressure is preferably performed when an output of an engine is low. Additionally, an assist force adjusting mechanism may be provided between the arm and the boom.

EFFECT OF THE INVENTION

According to the above-mentioned invention, a movement of the arm in a closing direction (a direction of excavation) is assisted. Thereby, an appropriate boom assist force according to the arm angle can be obtained, and energy can be efficiently recovered. Moreover, because the arm is also assisted during excavation, the output of the engine is averaged, and the engine can be miniaturized.

DETAILED DESCRIPTION OF THE PREFERRED EMBODIMENTS

A description will be given, with reference to the drawings, of embodiments of the present invention.

First, a description is given of a hydraulic shovel, which is an example of a construction machine performing an operating method according to the present invention. The construction machine to which the operating method according to the present invention is applied is not limited to a hydraulic shovel, and may be hydraulic working equipment that drives an attachment using a boom and an arm. For example, the present invention is applicable to a so-called lifting-magnet construction machine that is a hydraulic shovel of which bucket is replaced by a lifting magnet.

Figure 1:
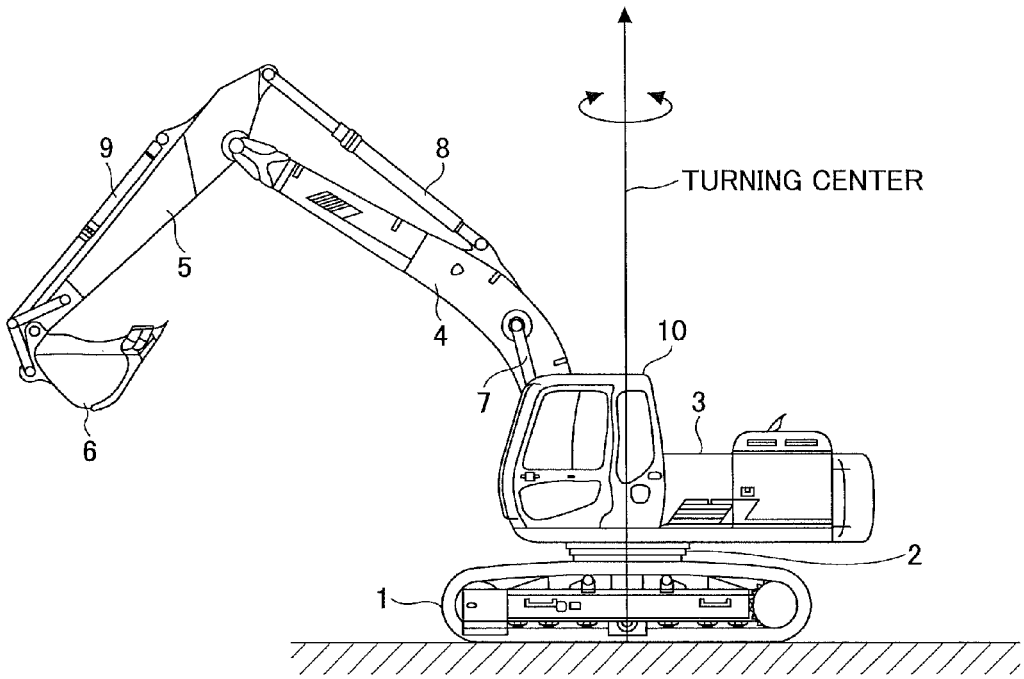
FIG. 1 is a side view of a hydraulic shovel.

FIG. 1 is a side view of a hydraulic pump, which is an example of a construction machine. An upper-part turning body 3 is mounted on a lower-part running body 1 of the hydraulic shovel via a turning mechanism 2. A boom 4 extends from the upper-part turning body 3, and an arm 5 is connected to an extreme end of the boom 4. A bucket 6 is connected to an extreme end of the arm 5. The boom 4, the arm 5 and the bucket 6 are hydraulically driven by a boom cylinder 7, an arm cylinder 8 and a bucket cylinder 9, respectively. A cabin 10 as an operator room and an engine as a power source (not illustrated in the figure) are mounted on the upper-part turning body 3.

The boom 4 is turnably supported up and down on the upper-part turning body 3. A boom angle sensor (not illustrated in the figure) is attached to a turning support part (joint). A boom angle, which is an inclination angle of the boom 4 from a horizontal direction, can be detected by the boom angle sensor.

The arm 5 is turnably supported at an extreme end of the boom. An arm angle sensor (not illustrated in the figure) is attached to a turning support part (joint). An arm angle, which is an inclination angle from a horizontal direction, can be detected by the arm angle sensor.

The bucket 6 is turnably supported at an extreme end of the arm 5. A bucket angle sensor (not illustrated in the figure) is attached to a turning support part (joint). A bucket angle, which is an inclination angle of the bucket 6 with respect to the arm 5, can be detected by the bucket angle sensor.

A turning angle sensor (not illustrated in the figure) is provided in the turning mechanism 2 which causes the upper-part turning body 3 to turn. A tuning angle, which is an angle from a position where the upper-part turning body 3 faces the front, can be detected by the turning angle sensor.

Figure 2:
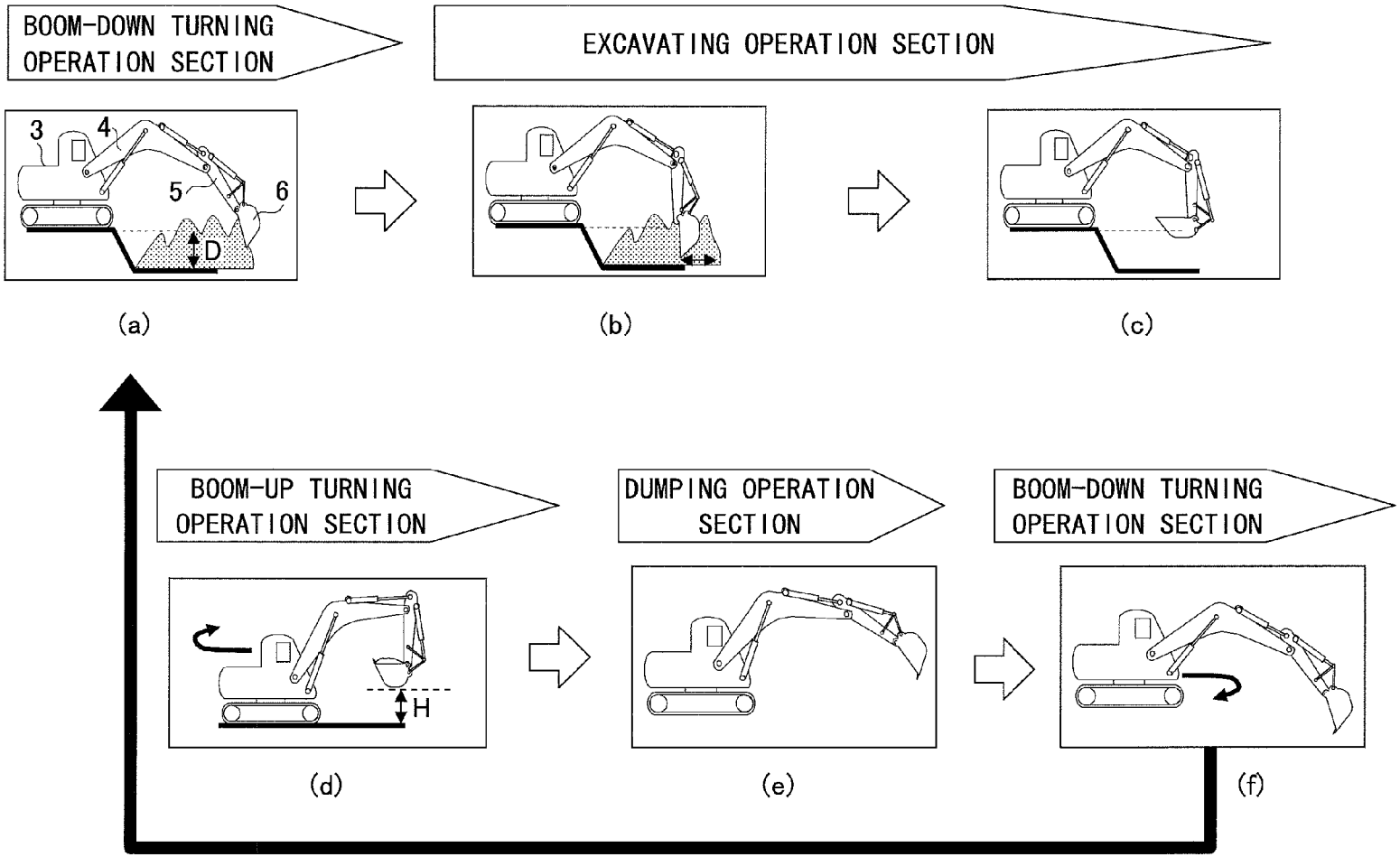
FIG. 2 is an illustration for explaining excavating-loading operation.

For example, an excavating-loading operation as illustrated in FIG. 2 can be performed using the hydraulic shovel having the above-mentioned structure. A description will be given in detail later of the excavating-loading operation performed using the hydraulic shovel according to the embodiment of the present invention.

Figure 3:
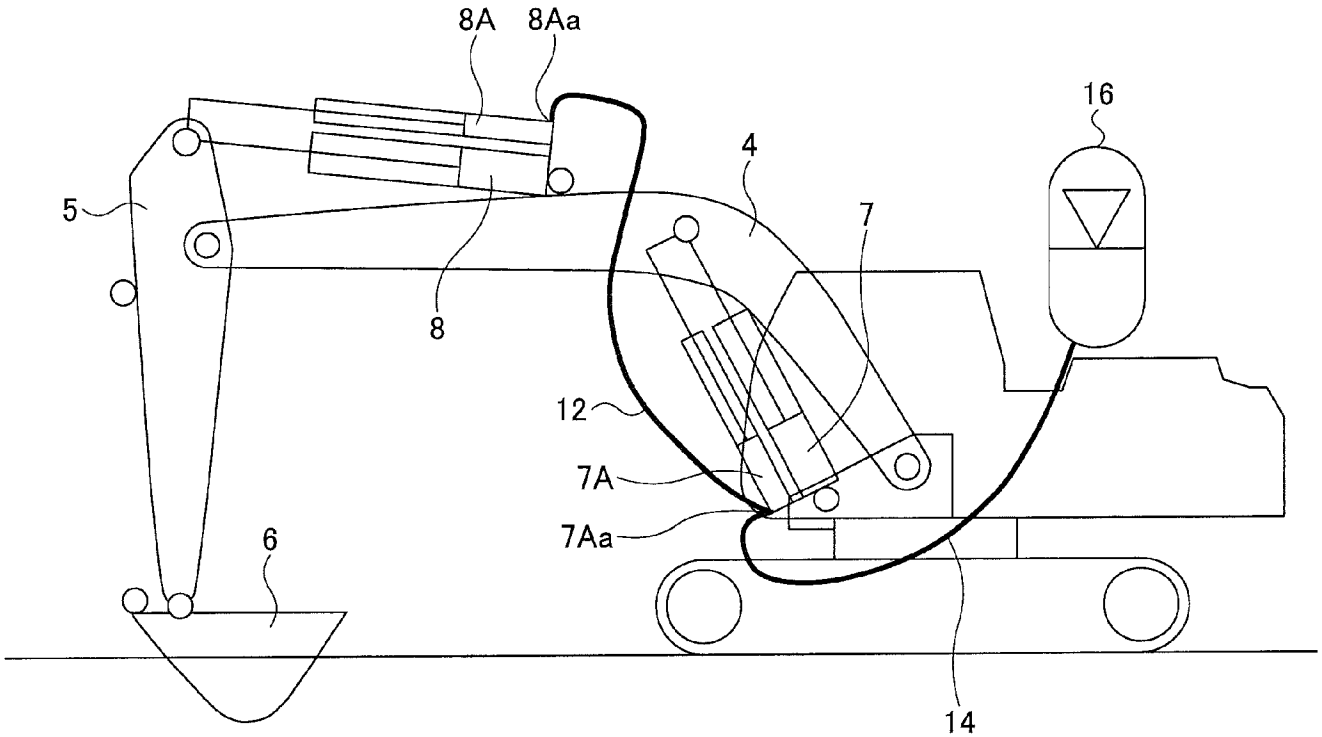
FIG. 3 is a simplified diagram illustrating a structure of the hydraulic shovel, which is an example of a construction machine according to an embodiment of the present invention.

FIG. 3 is a simplified diagram illustrating a hydraulic shovel as an example of a construction machine according to an embodiment of the present invention.

A boom assist cylinder 7A is provided to the boom cylinder 7, which drives the boom 4. An arm assist cylinder 8A is provided to the arm cylinder 8, which drives the arm 5. A hydraulic connection port 8Aa of the arm assist cylinder 8A is connected to a hydraulic connection port 7Aa of the boom assist cylinder 7A through a hydraulic pipe 12. A hydraulic connection port 7Aa of the boom assist cylinder 7A is connected to an accumulator 16 by a hydraulic pipe 14.

The boom assistant cylinder 7A is arranged parallel to the boom cylinder 7. When the boom 4 is lowered, a hydraulic pressure in the boom assist cylinder 7A is accumulated in the accumulator 16 from the hydraulic connection port 7Aa through the hydraulic pipe 14. On the other hand, when the boom 4 is raised, a hydraulic pressure is supplied from the accumulator 16 to the hydraulic connection port 7Aa of the boom assist cylinder 7A through the hydraulic pipe 14. Thereby, a rod of the boom assist cylinder 7A extends to assist the boom 4 in a direction of lifting the boom 4.

The arm assist cylinder 8A is arranged parallel to the arm cylinder 8. When the arm 5 is opened, a hydraulic pressure in the arm assist cylinder 8A is accumulated in the accumulator 16 from the hydraulic connection port 8Aa through the hydraulic pipes 12 and 14. On the other hand, when the arm 5 is closed, a hydraulic pressure is supplied from the accumulator 16 to the hydraulic connection port 8Aa of the arm assist cylinder 8A through the hydraulic pipes 12 and 14. Thereby, a rod of the arm assist cylinder 8A extends to assist the arm 5 in a direction of closing the arm 5.

The accumulator 16 is a container which accumulates operation oil, and air is confined inside thereof. When the operation oil is supplied to an accumulator 16, the operation oil flows into the accumulator 16 while compressing the air inside the container. Thereby, the operation oil in the accumulator 16 is in a state where a pressure is applied by an air pressure inside. Therefore, the accumulator 16 generates a hydraulic pressure in proportion to an amount of operation oil accumulated therein.

Figure 4:
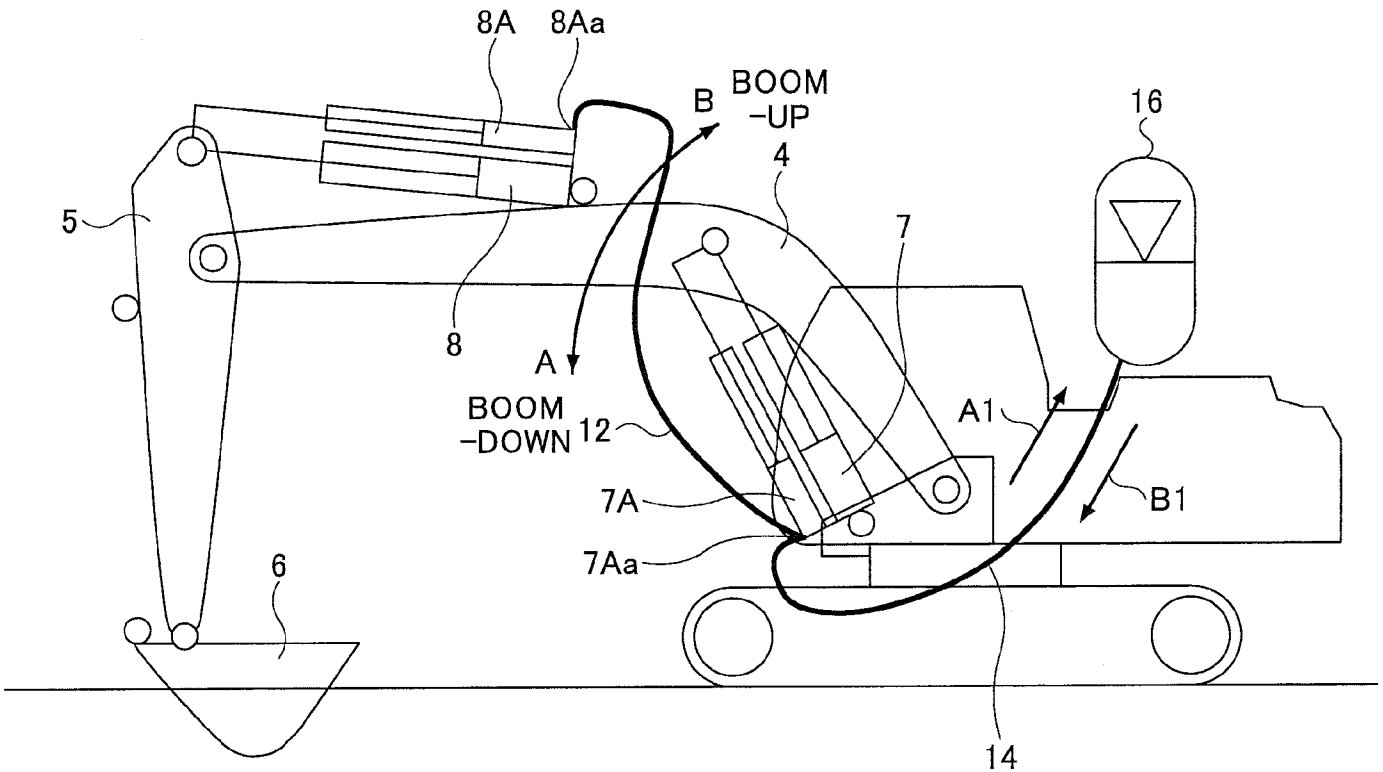
FIG. 4 is a diagram illustrating a flow of operation oil between a boom assist cylinder and an accumulator when driving a boom.

FIG. 4 is a diagram illustrating a flow of the operation oil between the boom assist cylinder 7A and the accumulator 16 when driving the boom 4. When moving the boom 4 downward (when rotating the boom 4 in a direction of arrow A), the boom 4 is moved downward while supporting the boom 4. Thus, a hydraulic pressure is supplied to the boom cylinder 7 from a hydraulic pump so that the rod of the boom cylinder 7 is retracted into the cylinder. Thereby, the boom 4 is rotated about a support axis as a center and an extreme end thereof is moved downward. At this time, the rod of the boom assist cylinder 7A is pushed by the boom 4 and moves into the cylinder, and, thereby, the operation oil is discharged from the hydraulic connection port 7Aa of the boom assist cylinder 7A. The operation oil discharged from the hydraulic connection port 7Aa flows inside the hydraulic pipe 14 in the direction of arrow A, and flows into and accumulated in the accumulator 16. The operation oil accumulated in the accumulator 16 is pressurized by the air pressure inside the accumulator 16, and a hydraulic pressure is generated. The hydraulic pressure corresponds to energy recovered by the boom assist cylinder 7A.

On the other hand, when moving the boom 4 upward (when rotating the boom 4 in a direction of arrow B), a hydraulic pressure is supplied to the boom cylinder 7 from the hydraulic pump, and the rod of the boom cylinder 7 is extended. Thereby, the boom 4 is rotated about a support axis as a center, and an extreme end thereof is moved upward. At this time, because the rod of the boom assist cylinder 7A extends from the cylinder, the operation oil flows into the hydraulic connection port 7Aa of the boom assist cylinder 7A. That is, the operation oil accumulated in the accumulator 16 flows inside the hydraulic pipe 14 in the direction of arrow B, and is supplied to the boom assist cylinder 7A. Because the hydraulic pressure is generated in the operation oil accumulated in the accumulator 16 as mentioned above, the boom assist cylinder 7A is driven by the hydraulic pressure, and a pressing force in the direction of moving the boom 4 upward (the direction of arrow B) is generated. This pressing force is an assist force to assist the boom 4.

As mentioned above, by providing the boom assist cylinder 7A, a part of energy given to the boom 4 and the potential energy on the boom 4 are recovered as a hydraulic pressure of the operation oil, and the hydraulic pressure can be accumulated in the accumulator 16. Then, when driving the boom 4, an operation of the boom 4 can be assisted by supplying the hydraulic pressure accumulated in the accumulator 16 to the boom assist cylinder 7A.

Figure 5:
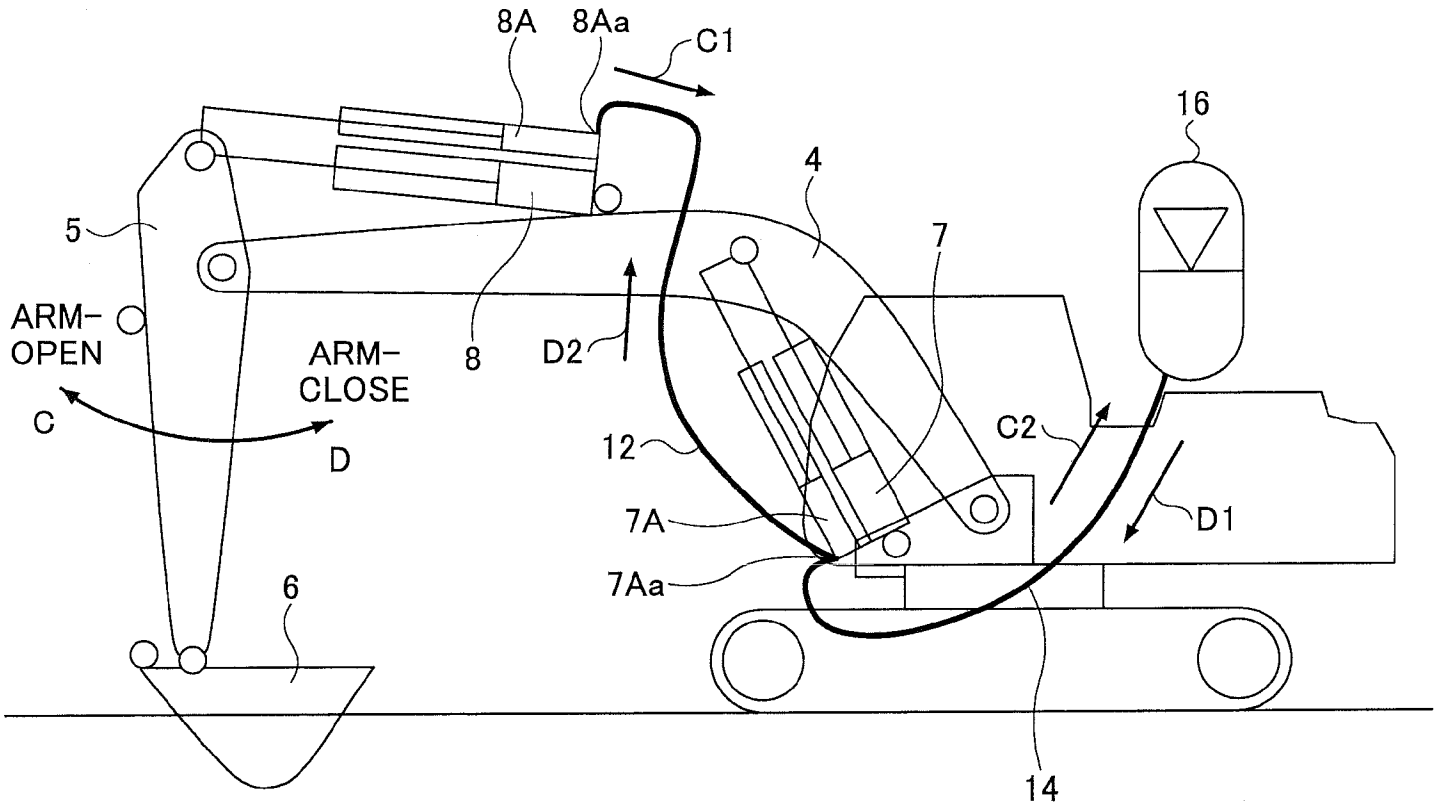
FIG. 5 is a diagram illustrating a flow of operation oil between an arm assist cylinder and the accumulator when driving an arm.

FIG. 5 is a diagram illustrating a flow of the operation oil between the arm assist cylinder 8A and the accumulator 16 when driving the arm 5. When the arm 5 is opened (when the arm 5 is rotated in a direction of arrow C), a hydraulic pressure is supplied from the hydraulic pump to the arm cylinder 8, and the rod of the arm cylinder 8 is driven to move into the cylinder. Thereby, the arm 5 is rotated about the support axis as a center, and the extreme end thereof is moved in a direction to separate from the boom 4 (the extreme end rotates in a direction of arrow C). At this time, because the rod of the arm assist cylinder 8A is pushed by the arm 5 and moves into the cylinder, the operation oil is discharged from the hydraulic connection port 8Aa of the arm assist cylinder 8A. The operation oil discharged from the hydraulic connection port 8Aa flows inside the hydraulic pipe 12 in a direction of arrow C1, and is supplied to the hydraulic connection port 7Aa of the boom assist cylinder 7A. Because the hydraulic pipe 14 is also connected to the hydraulic connection port 7Aa, the operation oil supplied to the hydraulic connection port 7Aa flows through the hydraulic pipe 14 in a direction of arrow C2 and is supplied to and accumulated in the accumulator 16. The operation oil accumulated in the accumulator 16 is pressurized by the air pressure inside the accumulator 16, and a hydraulic pressure is generated. This hydraulic pressure corresponds to energy recovered by the arm assist cylinder 8A.

On the other hand, when the arm 5 is closed (when the arm 5 is rotated in a direction of arrow D), a hydraulic pressure is supplied to the arm cylinder 8 from the hydraulic pump, and the rod of the arm cylinder 8 is extended. Thereby, the arm 5 is rotated about the support axis as a center, and an extreme end thereof is attracted toward the cabin. At this time, because the rod of the arm assist cylinder 8A extends out of the cylinder, the operation oil flows into the hydraulic connection port 8Aa of the arm assist cylinder 8A. That is, the operation oil accumulated in the accumulator 16 flows inside the hydraulic pipe 14 in a direction of arrow D1, and, thereafter, flows inside the hydraulic pipe 12 in a direction of arrow D2, and is supplied to the arm assist cylinder 8A. Because the hydraulic pressure is generated in the operation oil accumulated in the accumulator 16 as mentioned above, the arm assist cylinder 8A is driven by the hydraulic pressure, and a pressing force is generated in a direction of closing the arm 5 (a direction of arrow B). This pressing force corresponds to an assist force to assist the arm 5.

As mentioned above, a part of energy given when opening the arm 5 can be accumulated in the accumulator 16 as a hydraulic pressure of the operation oil. Then, by providing the arm assist cylinder 8A, the operation of the arm 5 can be assisted by supplying the hydraulic pressure accumulated in the accumulator 16 to the arm assist cylinder 8A when driving the arm 5.

Figure 6:
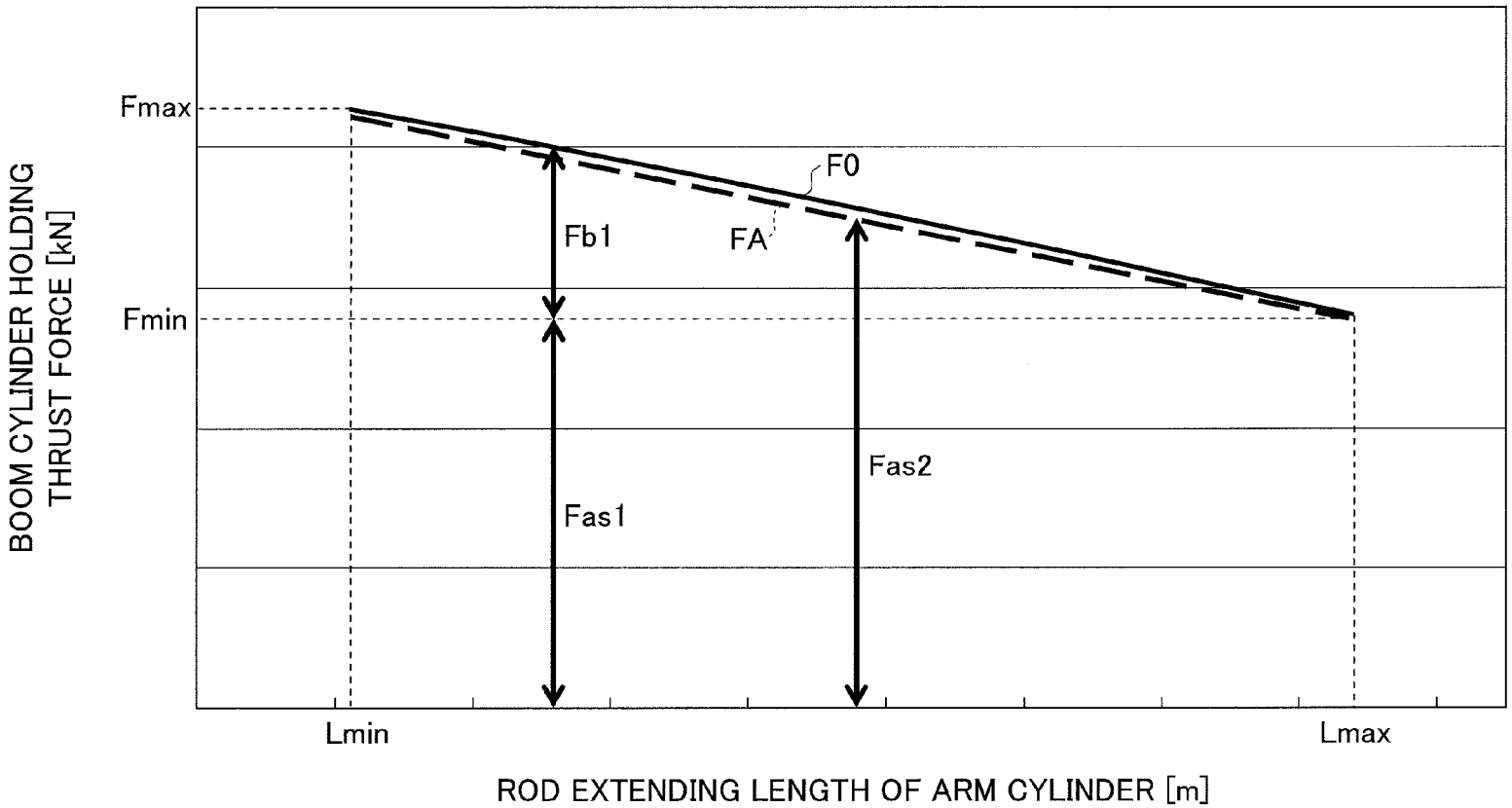
FIG. 6 is a graph illustrating a change in holding thrust force generated by the boom cylinder when the arm is changed between an open limit and a close limit while retaining the boom at a fixed position.

Here, a description is given, with reference to FIG. 6, of an effect of a case where the arm assist cylinder 8A is provided in addition to the boom assist cylinder 7A. FIG. 6 is a graph illustrating a change in a holding thrust force generated by the boom cylinder 7 when the arm 5 is changed between an open limit and a close limit while the boom 4 is retained at a fixed position.

Because the arm 5 is rotated in a direction of arrow C in FIG. 5 when opening the arm 5, a hydraulic pressure is supplied to the arm cylinder 8 so that the rod of the arm cylinder 8 moves into the cylinder. An extending length of the rod of the arm cylinder 8 is the arm cylinder length in the graph of FIG. 6, and is indicated by the horizontal axis. The arm cylinder length when the rod of the arm cylinder 8 extends at maximum (that is, an extending length of the rod of the arm cylinder 8 at an arm close limit) corresponds to Lmax on the horizontal axis. On the other hand, the arm cylinder length when the rod of the arm cylinder 8 extends at minimum (that is, an extending length of the rod of the arm cylinder 8 at an arm open limit) corresponds to Lmin on the horizontal axis.

When the arm cylinder length is Lmin, a boom cylinder holding thrust force is at a maximum value Fmax. That is, when the arm 5 is opened to the maximum, a moment by the arm 5 is at the maximum, and the boom cylinder holding thrust force for retaining the boom 4 at a fixed position is at the maximum value Fmax. On the other hand, when the arm cylinder length is Lmax, the boom cylinder holding thrust force is at a minimum value Fmin. That is, when the arm 5 is closed to the minimum, a moment by the arm 5 is at the minimum, and the boom cylinder holding thrust force for retaining the boom 4 at a fixed position is at the minimum value Fmin.

A description is given below of an effect of a case where the arm assist cylinder 8A is provided. A comparison is made between a case where only the boom assist cylinder 7A is provided and the arm assist cylinder is not provided, and a case where the arm assist cylinder 8A is provided in addition to the boom assist cylinder 7A.

First, description is given of the case where the arm assist cylinder 8A does not exist. The boom 4 is retained at a fixed position by a holding thrust force Fb1 generated by the boom cylinder 7 and a holding thrust force Fas1 generated by the boom assist cylinder 7A. It is assumed that the hydraulic pressure of the accumulator 16 and the cylinder diameter of the boom assist cylinder 7A are set so that the holding thrust force Fas1 generated by the boom assist cylinder 7A is equal to a boom cylinder holding thrust force (corresponding to Fmin) required at the time of the arm close limit. In this case, as indicated by a solid line F0 in the graph of FIG. 6, the boom cylinder holding thrust force to retain the boom at a fixed position gradually increases from the boom cylinder holding thrust force Fmin required at the time of the arm close limit to the boom cylinder holding thrust force Fmax required at the time of the arm open limit.

When the arm assist cylinder 8A does not exist, a thrust force for increasing the boom cylinder holding thrust force (that is, a thrust force obtained by subtracting the holding thrust force Fas1 generated by the boom assist cylinder 7A from the required boom cylinder holding thrust force) is a thrust force Fb1 generated by the boom cylinder 7. Therefore, at the time of the arm close limit, there is no need to supply a hydraulic pressure to the boom cylinder 7 from the hydraulic pump, and the boom cylinder holding thrust force is provided only by the holding thrust force Fas1 generated by the arm assist cylinder 8A. As the arm 5 opens, the holding thrust force Fb1 generated by the boom cylinder 7 is increased by the hydraulic pressure supplied from the hydraulic pump to the boom cylinder 7 being increased, as indicated by the solid line F0 in FIG. 6. At the time of the arm open limit, the hydraulic pressure supplied from the hydraulic pump to the boom cylinder 7 is at a maximum, and the boom cylinder holding thrust force is at the maximum value Fmax.

The above is a change in the boom cylinder holding thrust force when the arm assist cylinder 8A does not exist, but when the arm assist cylinder 8A is provided, a holding thrust force generated by the boom assist cylinder 7A driven by a hydraulic pressure from the accumulator 16 becomes a change indicated by a dotted line FA in the graph of FIG. 6.

That is, when the arm assist cylinder 8A is provided, at the time of the arm close limit, similar to the case where the arm assist cylinder 8A is not provided, the cylinder holding thrust force is provided only by the holding thrust force Fas1 generated by the boom assist cylinder 7A. As the arm 5 opens, the extending length of the rod of the arm assist cylinder 8A (arm cylinder length) decreases. The operation oil in the arm assist cylinder 8A flows toward the accumulator 16, and the hydraulic pressure in the accumulator 16 rises. According to the raise of the hydraulic pressure in the accumulator 16, the hydraulic pressure supplied to the boom assist cylinder 7A rises, and the holding thrust force generated by the boom assist cylinder 7A increases. By appropriately adjusting the capacity of the accumulator 16, the cylinder diameter of the boom assist cylinder 7A, the cylinder diameter of the arm assist cylinder 8A, etc., the holding thrust force Fa2 generated by the boom assist cylinder 7A is set to the change indicated by the dotted line FA of FIG. 6. That is, a most part of the boom cylinder holding thrust force can be provided only by the thrust force Fas2 generated by the boom assist cylinder 7A.

In this case, almost the entire boom assist cylinder holding force required to retain the boom 4 at a fixed position can be provided only by the holding force Fa2 generated by the boom assist cylinder 7A. Accordingly, a hydraulic pressure to be supplied from the hydraulic pump to the boom cylinder 7 to retain the boom 4 when the arm 5 is open can be greatly reduced.

As mentioned above, by providing the boom assist cylinder, the hydraulic pressure from the arm assist cylinder 8A is recovered into the accumulator 16, thereby automatically increasing the boom cylinder holding force by supplying the recovered hydraulic pressure to the boom assist cylinder 7A. Thus, the hydraulic pressure supplied from the hydraulic pump to the boom cylinder 7 to acquire the boom cylinder holding thrust force necessary for retaining the boom 4 can be greatly reduced.

In the present embodiment, the hydraulic connection port 8Aa of the arm assist cylinder 8A is connected to the accumulator 16 through the hydraulic pipe 12, the hydraulic connection port 7Aa of the boom assist cylinder 7A, and the hydraulic pipe 14. This hydraulic circuit is equivalent to a hydraulic circuit in which each of the boom assist cylinder 7A and the arm assist cylinder 8A is connected independently to the accumulator 16. The length of the entire hydraulic piping can be made short by using the hydraulic circuit constituted by connecting the hydraulic connection port 8Aa of the arm assist cylinder 8A to the accumulator 16 through the hydraulic pipe 12, the hydraulic connection port 7Aa of the boom assist cylinder 7A, and the hydraulic pipe 14.

Figure 7:
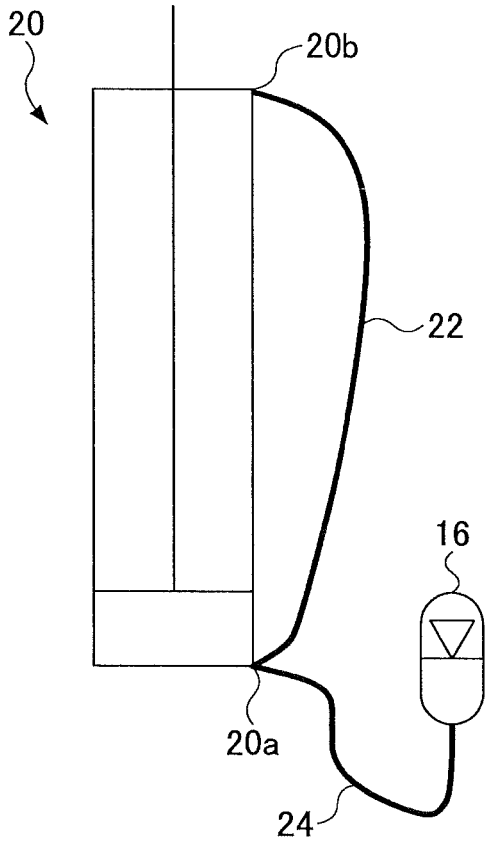
FIG. 7 is a diagram illustrating hydraulic piping when using a double-acting cylinder as an assist cylinder.

Although a single-acting cylinder may be used as the above-mentioned boom assist cylinder 7A and arm assist cylinder 8A, a double-acting cylinder can also be used. When using a double-acting cylinder, as illustrated in FIG. 7, two hydraulic connection ports 20*a* and 20*b* of the double-acting cylinder 20 may be connected by a hydraulic pipe 22, and only the hydraulic connection port 20*a* may be connected to the accumulator through a hydraulic pipe 24. According to such a piping arrangement, a double-acting cylinder can be functioned as a single-acting cylinder.

Next, a description is given of an example of a work operation performed by using a hydraulic shovel. As a typical operation performed by using a hydraulic shovel, there is an excavating-loading operation. The excavating-loading operation is a series of operations including an excavating operation and a loading operation, and is a work operation to excavate earth and exhaust the earth onto a predetermined place such as a loading platform of a dump car or the like. The excavating-loading operation is specified in detail in the Japan Construction Machinery and Construction Association Standard (JCMAS).

A description is given in detail, with reference to FIG. 2, of the excavating-loading operation. First, as illustrated in FIG. 2-(*a*), in a state where the upper-part turning body 3 is turned and the bucket 6 is positioned above an excavation position and in a state where the arm 5 is open and the bucket 6 is also open, the operator moves the boom down to move the bucket 6 downward so that a tip of the bucket 6 reaches a target excavation depth D. Usually, the turning and boom down is operated by the operator and the operator visually recognizes the position of the bucket 6. It is usual to perform the turning of the upper-part turning body 3 and the lowering of the boom 4 simultaneously. The above-mentioned operation is referred to as a boom down turning operation, and the operation section is referred to as a boom down turning operation section.

When the operator judges that the tip of the bucket 6 reaches the target excavation depth D, then, the operation proceeds to a horizontal drawing operation as illustrated in FIG. 2-(*b*). In the horizontal drawing operation, the arm 5 is closed until the arm 5 becomes perpendicular to the ground so that the tip of the bucket 6 moves horizontally. According to the horizontal drawing operation, the earth of a predetermined depth is excavated and scraped together by the bucked. After completion of the horizontal drawing operation, then, the bucket 6 is closed until it becomes 90 degrees with respect to the arm 5. That is, the bucket 6 is closed until an upper edge of the bucket 6 becomes horizontal, and the scraped earth is accommodated inside the bucket 6. The above-mentioned operation is referred to as an excavating operation, and the operation section is referred to as an excavating operation section.

When the operator judges that the bucket 6 is closed to be 90 degrees, next, as illustrated in FIG. 2-(*d*), the operator moves the boom 4 up until a bottom part of the bucket 6 reaches a predetermined height H while the bucket 6 is maintained closed. Subsequently or simultaneously, the operator turn the upper-part turning body 3 to turn and move the bucket 6 to a position of dumping the earth. The above-mentioned operation is referred to as a boom-up turning operation, and the operation section is referred to as a boom-up turning operation section.

The reason for raising the boom 4 until the bottom part of the bucket 6 reaches the predetermined height H is because, when earth is dumped onto the loading platform of a dump car, the bucket 6 hits the loading platform unless the bucket 6 is raised at a position higher than the height of the loading platform.

When the operator judges that the boom-up turning operation is completed, then, as illustrated in FIG. 2-(*e*), the operator opens the arm 5 and the bucket 6 to dump the earth accommodated in the bucket 6. This operation is referred to as a dumping operation, and the operation section is referred to as a dumping operation section. In the dumping operation, earth may be dumped by opening only the bucket 6.

When the operator judges that the dumping operation is completed, then, as illustrated in FIG. 2-(*f*), the operator turns the upper-part turning body 3 to move the bucket 6 directly above the excavation position. At this time, the operator moves the boom 4 down simultaneously to move the bucket 6 down to an excavation start position. This operation is a part of the boom-down turning operation explained with reference to FIG. 2-(*a*). The operator moves the bucket 6 down from the excavation start position to the target excavation depth D, and performs the excavating operation illustrated in FIG. 2-(*b*) again.

The above-mentioned "boom-down turning operation", "excavating operation", "boom-up turning operation", "dumping operation", and "boom-down turning operation" are made into one cycle, and the excavating-loading operation is progressed while repeating this cycle.

In the operation explained above, the boom 4 is raised greatly in the boom-up turning operation section illustrated in FIG. 2-(*d*), and the arm 5 is raised (opened) greatly in the dumping operation section illustrated in FIG. 2-(*e*). At this time, a large potential energy is generated in the boom 4 due to a self-weight of the boom 4 and a weight of the bucket 6. The boom 4, which is raised largely in the boom-up turning operation section, is moved down in the boom-down turning operation section. Accordingly, it is possible to assist the boom 4, when raising the boom 4 next, by accumulating the potential energy generated in the boom-up turning operation section as a hydraulic pressure.

Moreover, a larger drive force is required for the arm 5 in the excavating operation section than the dumping operation section. Thus, a hydraulic pressure generated by an output of the engine is accumulated when the arm is opened largely in the dumping operation section where a required power is relatively small, and an assist can be made when the excavation operation is performed by the arm 5 in a next excavating operation section.

In order to recover and reuse the potential energy of the attachment as mentioned above, according to an embodiment of the present invention, a potential energy recovering hydraulic cylinder is provided to the boom 4 to recover the potential energy. The recovered hydraulic pressure is accumulated in the accumulator, and is used to assist the operation of the boom 4.

Moreover, with respect to the arm 5, the arm assist cylinder 8A for accumulating a hydraulic pressure in a section where a required output is small is provided to the arm 5. The arm assist cylinder 8A accumulates an output of the engine as a hydraulic pressure. The hydraulic pressure accumulated in the arm assist cylinder is used to assist the operation of the arm 5.

Figure 8:
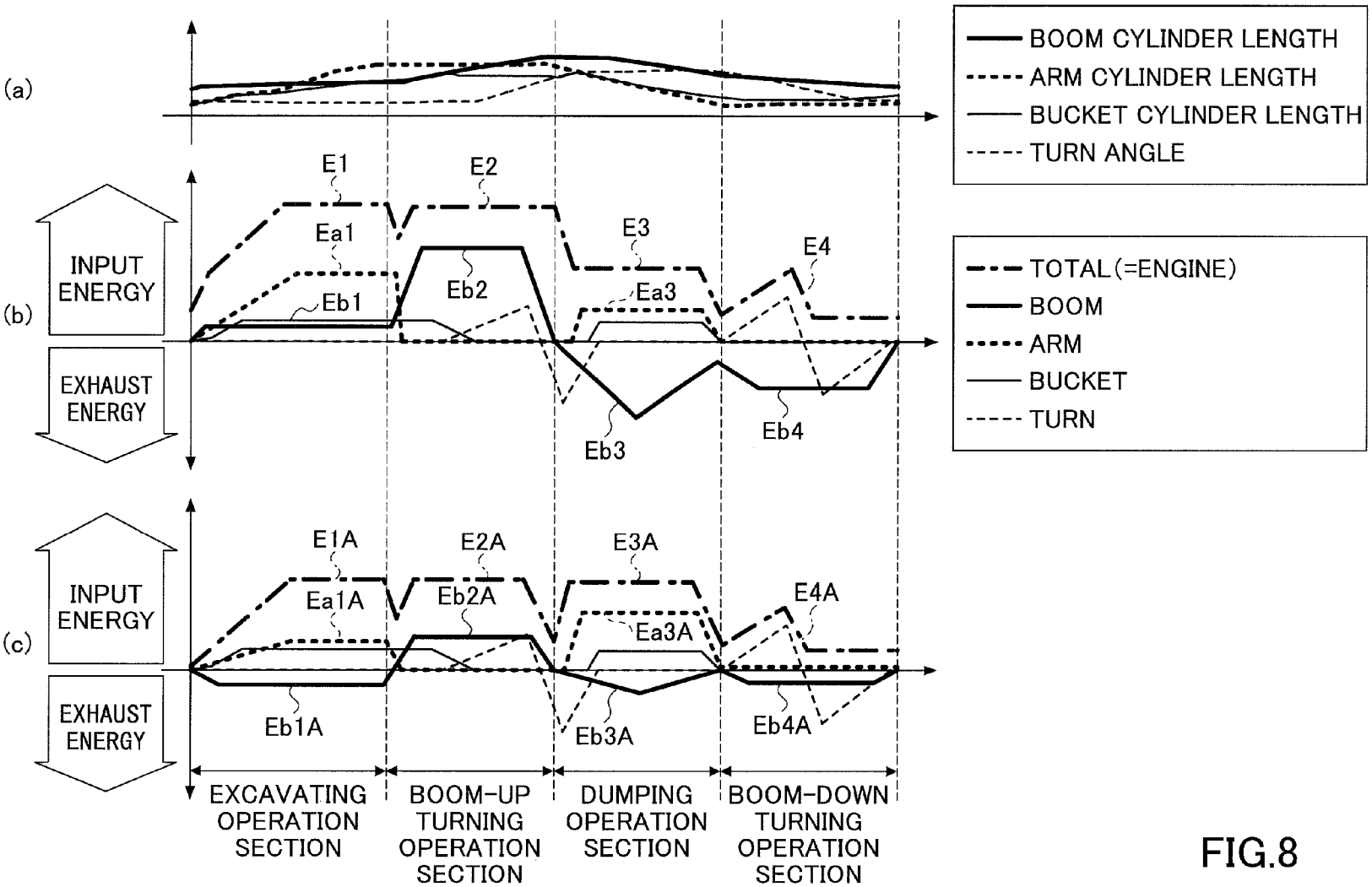
FIG. 8 is a graph illustrating input and output of energy when an excavating-loading operation is performed by the hydraulic shovel according to an embodiment of the present invention.

FIG. 8 is a graph illustrating energy input and output when the excavating-loading operation illustrated in FIG. 2 is performed by a hydraulic shovel. FIG. 8-(*a*) is a graph indicating changes in a boom cylinder length, an arm cylinder length, a bucket cylinder length, and a turn angle during the excavating-loading operation. FIG. 8-(*b*) is a graph indicating input and output of energy in a conventional hydraulic shovel. FIG. 8-(*c*) is a graph indicating input and output of the hydraulic shovel according to the present embodiment.

In the excavating operation section, energies Ea1 and Eb1 are used by the operation of closing the arm and the operation of closing the bucket. In the hydraulic shovel according to the present embodiment, an assist is performed by supplying a hydraulic pressure (energies Ea1A and Eb1A) from the accumulator 16 to the arm assist cylinder 8A and the boom assist cylinder 7A in the operation of closing the arm 5. Accordingly, the total energy input (energy E1A) in the excavating operation section by the hydraulic shovel according to the present embodiment is lower than the total energy input (energy E1) in the excavating operation section by a conventional hydraulic shovel having no assist.

In the subsequent boom-up turning operation section, energy Eb2 is used for the operation of raising the boom. In the hydraulic shovel according to the present embodiment, an assist is performed by supplying a hydraulic pressure (energy Eb2A) from the accumulator 16 to the boom assist cylinder 7A in the operation of raising the boom 4. Accordingly, the total energy input (energy E2A) in the boom-up turning operation section by the hydraulic shovel according to the present embodiment is lower than the total energy input (energy E2) in the boom-up turning operation section by a conventional hydraulic shovel having no assist.

In the subsequent dumping operation section, energy Ea3 is used for an operation of opening the arm. At this time, in the hydraulic shovel according to the present embodiment, the operation of opening the arm 5 is performed and also an operation of recovering energy by the arm assist cylinder 8A is performed. That is, the operation oil in the arm assist cylinder 8A is pressurized by the operation of opening the arm 5 and is supplied to the accumulator 16 (energy Ea3A). Accordingly, the total energy input (energy E3A) in the dumping operation section by the hydraulic shovel according to the present embodiment is higher than a total energy input (energy E3) in the dumping operation section by a conventional hydraulic shovel having no assist.

In the dumping operation, a force is acted in a direction of moving the boom 4 down because the arm 5 is largely in the opened position. In order to retain the position of the boom 4 against the force of moving the boom down, a hydraulic pressure is supplied to the boom cylinder 7. In a conventional hydraulic shovel, this hydraulic pressure is not an input energy for an operation, but exhaust energy Eb3. In the hydraulic shovel according to the present embodiment, energy is recovered by receiving a part of the force acting in the direction of moving the boom down by the boom assist cylinder 7A, and is accumulated in the accumulator 16. Thus, according to the hydraulic shovel according to the present embodiment, the exhaust energy Eb3A in the dumping operation section can be smaller by the energy recovered by the boom assist cylinder 7A. Thus, the hydraulic shovel according to the present embodiment can efficiently recover the exhaust energy and reuse the recovered energy after accumulating the recovered energy in the accumulator 16.

In the subsequent boom-down turning operation section, an operation of moving the boom down is performed. In the operation of moving the boom down, the boom is moved down by utilizing weights (energy) of the bucket, the arm and the boom. In a conventional hydraulic shovel, because the boom is moved down while supporting the boom by the boom cylinder, it is necessary to supply a hydraulic pressure to the boom cylinder. This energy is not input energy for an operation but exhaust energy. In the hydraulic shovel according to the present embodiment, because the potential energy Eb4 when the boom moves down is recovered by the boom assist cylinder 7A and accumulated in the accumulator 16 as a hydraulic pressure, the exhaust energy Eb4A in the boom-down turning operation section is smaller than an exhaust energy of a conventional hydraulic shovel having no energy recovery. Additionally, the total energy input (energy E4A) in the boom-down turning operation section is smaller than the total energy input (energy E4) in the boom-down turning operation section in a conventional hydraulic shovel having no energy recovery. As mentioned above, according to the hydraulic shovel according to the present embodiment, a large effect can be obtained in that the exhaust energy in the boom-down turning operation section can be reduced and also the total input energy can be reduced.

As mentioned above, according to the hydraulic shovel according to the present embodiment, an effect can be obtained that not only enable recovering the boom exhaust energy effectively to reuse the recovered energy but also enable averaging the total input energy in each operation section. That is, as apparent from comparison between the total input energy indicated in FIG. 8-(*c*) and the total input energy indicated in FIG. 8-(*b*), the total input energy is large in the dumping operation section in the hydraulic shovel according to the present embodiment, however, the total input energy can be reduced in the excavating operation section and the boom-up turning operation section, and, the total input energy is averaged and a peak thereof is reduced in between those operation sections. Thereby, it is possible to obtain an effect that the hydraulic pump for generating the total input energy can be miniaturized and the engine to drive the hydraulic pump can also be miniaturized.

As mentioned above, in the hydraulic shovel according to the present embodiment, the hydraulic circuit is constructed to assist the boom 4 in a direction of raising and the arm 5 in a direction of closing (a direction of excavation). Thereby, an appropriate boom assist force can be obtained in response to the arm angle, and energy saving can be realized. Moreover, because the operation of the arm 5 is also assisted during excavation, it is possible to obtain an effect that the hydraulic output and the engine output are averaged and the hydraulic pump and the engine can be miniaturized.

Figure 9:
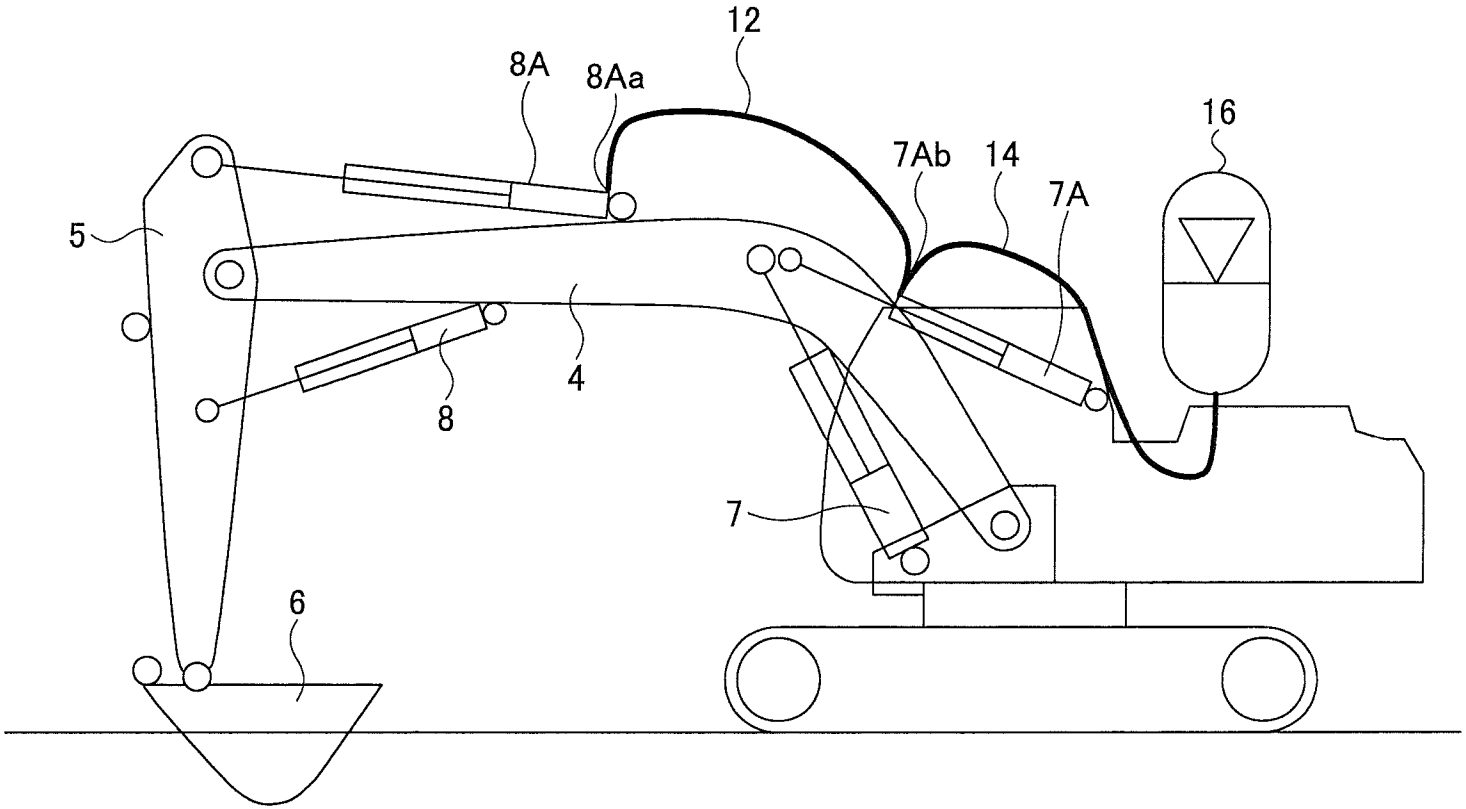
FIG. 9 is a diagram illustrating another example of arrangement of the boom assist cylinder and the arm assist cylinder.

It should be noted that although the boom assist cylinder 7A is attached to the boom cylinder 7 in parallel and the arm assist cylinder 8A is attached to the arm cylinder 8 in parallel, arrangement of the boom assist cylinder 7A and the arm assist cylinder 8A is not limited to this. For example, as illustrated in FIG. 9, the boom assist cylinder 7A may be attached at an angle with the boom cylinder 7 and the arm assist cylinder 8A may be attached at angle with the arm cylinder 8. It is necessary to also change the connection of the hydraulic pipes 12 and 14 suitably according to the arrangement of the boom assist cylinder 7A and the arm assist cylinder 8A. For example, in the example illustrated in FIG. 9, because the position of the boom assist cylinder 7A is changed, the pipes 12 and 14 are connected to the hydraulic connection port 7Ab of the rod side of the boom assist cylinder 7A in order to make the directions of assist to be the same direction. Thereby, the boom assist cylinder 7A is configured to be able to assist the boom 4 in a direction of raising.

Figure 10:
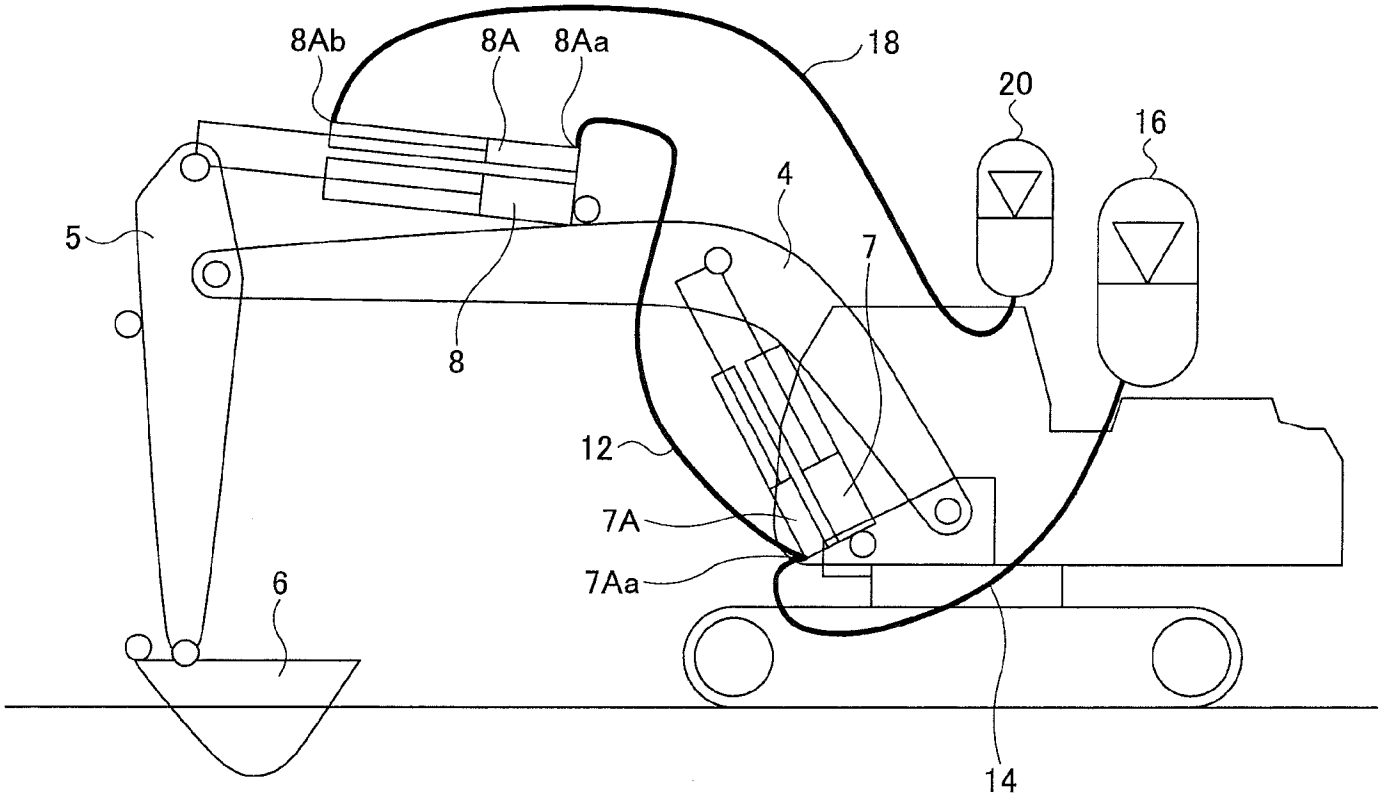
FIG. 10 is a diagram illustrating a hydraulic circuit structure when reducing an arm opening force.

Moreover, when it is desirable to reduce a force in a direction of opening the arm 5, as illustrated in FIG. 10, the arm assist cylinder 8A may be made as a double-acting cylinder, and the hydraulic connection port 8Ab of the rode side may be connected to another accumulator 20 through a hydraulic pipe 18. In this case, the arm assist cylinder 8A made by a double-acting cylinder and the accumulator 20 together constitute an assist force adjusting mechanism corresponding to assist force adjusting means.

The present invention is not limited to the specifically disclosed embodiments, and various variations and modifications may be made without departing from the scope of the present invention.

The present application is based on Japanese Patent Application No. 2010-097216 filed on Apr. 20, 2010, the entire contents of which are incorporated herein by reference.

Industrial Applicability

The present invention is applicable to a construction machine performing a work operation by driving a movable element such as a boom, an arm, etc.

EXPLANATION OF REFERENCE NUMERALS

1 lower-part running body
2 turning mechanism
3 upper-part turning body
4 boom
5 arm
6 bucket
7 boom cylinder
7A boom assist cylinder
7Aa, 7Ab hydraulic connection port
8 arm cylinder
8A arm assist cylinder
8Aa, 8Ab hydraulic connection port
9 bucket cylinder
10 cabin
12, 14, 18 hydraulic piping
16, 20 accumulator

The invention claimed is:

1. A construction machine that drives a work attachment by a boom and an arm, comprising:
- a boom assist cylinder that assists an operation of the boom by a hydraulic pressure;
- an arm assist cylinder that assists an operation of the arm by a hydraulic pressure;
- an accumulator that accumulates operation oil to be supplied to said boom assist cylinder and said arm assist cylinder in a pressurized state;
- a first hydraulic pipe connected between said boom assist cylinder and said arm assist cylinder; and
- a second hydraulic pipe connected between said arm assist cylinder and said accumulator via said first hydraulic pipe,
- wherein said first hydraulic pipe is connected to a hydraulic connection port of said arm assist cylinder such that the operation oil is supplied in a direction of closing said arm from said accumulator to said arm assist cylinder, and
- wherein the first hydraulic pipe is connected to the boom assist cylinder such that the operation oil is supplied in a direction of opening said boom from said arm assist cylinder to said boom assist cylinder.

2. The construction machine as claimed in claim 1, wherein said second hydraulic pipe is connected to a hydraulic connection port of said boom assist cylinder so that the operation oil is supplied in a direction of raising said boom from said accumulator to said boom assist cylinder.

3. The construction machine as claimed in claim 2, wherein accumulation of hydraulic pressure is performed when an output of an engine is low.

4. A construction machine that drives a work attachment by a boom and an arm, comprising:
- a boom assist cylinder that assists an operation of the boom by a hydraulic pressure;
- an arm assist cylinder that assists an operation of the arm by a hydraulic pressure;
- an accumulator that accumulates operation oil to be supplied to said boom assist cylinder and said arm assist cylinder in a pressurized state;
- a first hydraulic pipe connected between said boom assist cylinder and said arm assist cylinder; and a second hydraulic pipe connected between said arm assist cylinder and said accumulator via said first hydraulic pipe, wherein said first hydraulic pipe is connected to a hydraulic connection port of said arm assist cylinder so that the operation oil is supplied in a direction of closing said arm from said accumulator to said arm assist cylinder, wherein accumulation of hydraulic pressure is performed when an output of an engine is low, and wherein the first hydraulic pipe is connected to the boom assist cylinder such that the operation oil is supplied in a direction of opening said boom from said arm assist cylinder to said boom assist cylinder.

* * * * *